United States Patent [19]

Tremeaux

[11] 4,416,322

[45] Nov. 22, 1983

[54] MOULDING MACHINE, MORE ESPECIALLY A CHILL MOULDING MACHINE COMPRISING A FRAMEWORK AND AT LEAST ONE CORE EXTRACTION JACK MOUNTED ON A BEARING ELEMENT MOVABLE ON THE FRAMEWORK

[76] Inventor: Michel Tremeaux, 11 Rue Clément Ader, 71100 Chalon sur Saone, France

[21] Appl. No.: 268,771

[22] Filed: Jun. 1, 1981

[30] Foreign Application Priority Data

Jun. 27, 1980 [FR] France ..... 80 14425

[51] Int. Cl.[3] ..... B22D 33/04

[52] U.S. Cl. ..... 164/340; 164/345

[58] Field of Search ..... 164/339-343, 164/345, 346, 132

[56] References Cited

U.S. PATENT DOCUMENTS 1,318,380 10/1919 Hazelett ..... 164/340

FOREIGN PATENT DOCUMENTS 752539 8/1951 Fed. Rep. of Germany ..... 164/346

1199990 7/1970 United Kingdom ..... 164/343

*Primary Examiner*—Kuang Y. Lin

*Attorney, Agent, or Firm*—Charles E. Pfund

[57] ABSTRACT

A moulding machine comprising a framework and at least one core extraction jack mounted on a bearing element movable on the framework. It is characterized in that the bearing element (6) is carried by at least two supports (5) secured against motion to the guide devices (4) each comprising a securing member (8) clamping the corresponding guide device and at least one arm (9) integral with the securing member, the bearing element being fixed to an arm of each of the supports.

9 Claims, 8 Drawing Figures

MOULDING MACHINE, MORE ESPECIALLY A CHILL MOULDING MACHINE COMPRISING A FRAMEWORK AND AT LEAST ONE CORE EXTRACTION JACK MOUNTED ON A BEARING ELEMENT MOVABLE ON THE FRAMEWORK

The present invention relates to a moulding machine, more especially a chill moulding machine, comprising a framework and at least one core extraction or middle part extraction jack mounted on a bearing element movable on the framework.

Moulding machines, which are generally designed to receive moulds of different sizes, comprise adjusting devices by means of which their core extraction or middle part extraction jacks may be moved so that the distance separating them from the moulds is always within a range inside which they may be used to the best of their possibility.

Now, at present, the solutions proposed for changing the position of the jacks of moulding machines do not give entire satisfaction. These solutions in fact use complex, space-consuming and expensive adjusting devices. Changing the position of the jacks, when it is accomplished with these adjusting devices, is furthermore time-consuming, which does not allow the machine to be used to the maximum of its possibilities.

The present invention proposes removing these drawbacks and, for this, it provides a moulding machine, more especially a chill moulding machine, which is characterized in that the bearing element is carried by at least two supports secured against movement on guide devices provided on the framework, and in that the supports each comprise a securing member in engagement with the corresponding guide device and at least an arm integral with the securing member, the bearing element being fixed on an arm of each of these supports.

Because of the special structure of the supports of the invention, the core-extraction or middle part extraction jacks may now be brought simply, rapidly and accurately into the position which is best adapted to the size of the moulds used.

Advantageously, the bearing element is fixed on the arms by means of fixing members each cooperating with a complementary fixing member provided on each of said arms. The risk of an accidental movement thereof during operation of the jack is thus totally removed.

In a particularly advantageous arrangement, the arms comprise several complementary fixing members spread out over their length.

By causing the fixing members to cooperate selectively with one of the complementary fixing members provided on the support arms on which the bearing element is fixed, it is possible to finely adjust the distance separating the jack from the mould, which then allows a better matching of the machine to the type of mould used.

Preferably, the complementary fixing members are bores.

The jack bearing element may thus be fixed very simply, for example with screws or bolts engaging in one of the bores of the arms of the supports.

According to a preferred embodiment of the moulding machine of the invention, the guide devices are each formed by a cylindrical bar, whereas the member for securing the supports against movement are each formed by a collar clamping the corresponding cylindrical bar.

With this set of arrangements, the supports may be brought to and secured against movement in a multitude of positions along the guide devices. They may also occupy a multitude of angular positions about the guide devices. Thus, by suitably choosing the longitudinal and angular position of the supports on the cylindrical bars, the arms may extend in the direction which allows the bearing element, and so the jack, to be best positioned with respect to the mould used.

Preferably, the collar of each support is formed from two complementary parts assembled one against the other by removable connection means.

Positioning of the supports on the guide bars and their removal therefrom may thus be effected simply and rapidly, even if both ends of each of the guide bars receive an operational member whatever.

According to a first variation, the supports comprise a single arm fixed on the lateral surface of their collar. In this case, a support can therefore only seat a single bearing element.

According to a second variation, the supports comprise two arms fixed on the lateral surface of their collar, these arms being offset angularly with respect to each other and forming preferably a right angle therebetween.

The same support may in this case seat two bearing elements.

According to a further preferred embodiment of the moulding machine of the invention, the guide devices are each formed by two flat bars between which is provided a gap of constant width whereas the members for securing the supports against movement are each formed by a boss held between the two corresponding flat bars with which they present a small operational clearance.

In this case, the supports may be further secured against movement in a multitude of positions along the guide devices.

Preferably, the boss of each support is provided at one of the ends of the arms of said support.

Several embodiments of the present invention will be described hereafter by way of non limiting examples with reference to the accompanying drawings in which.

Figure 1:
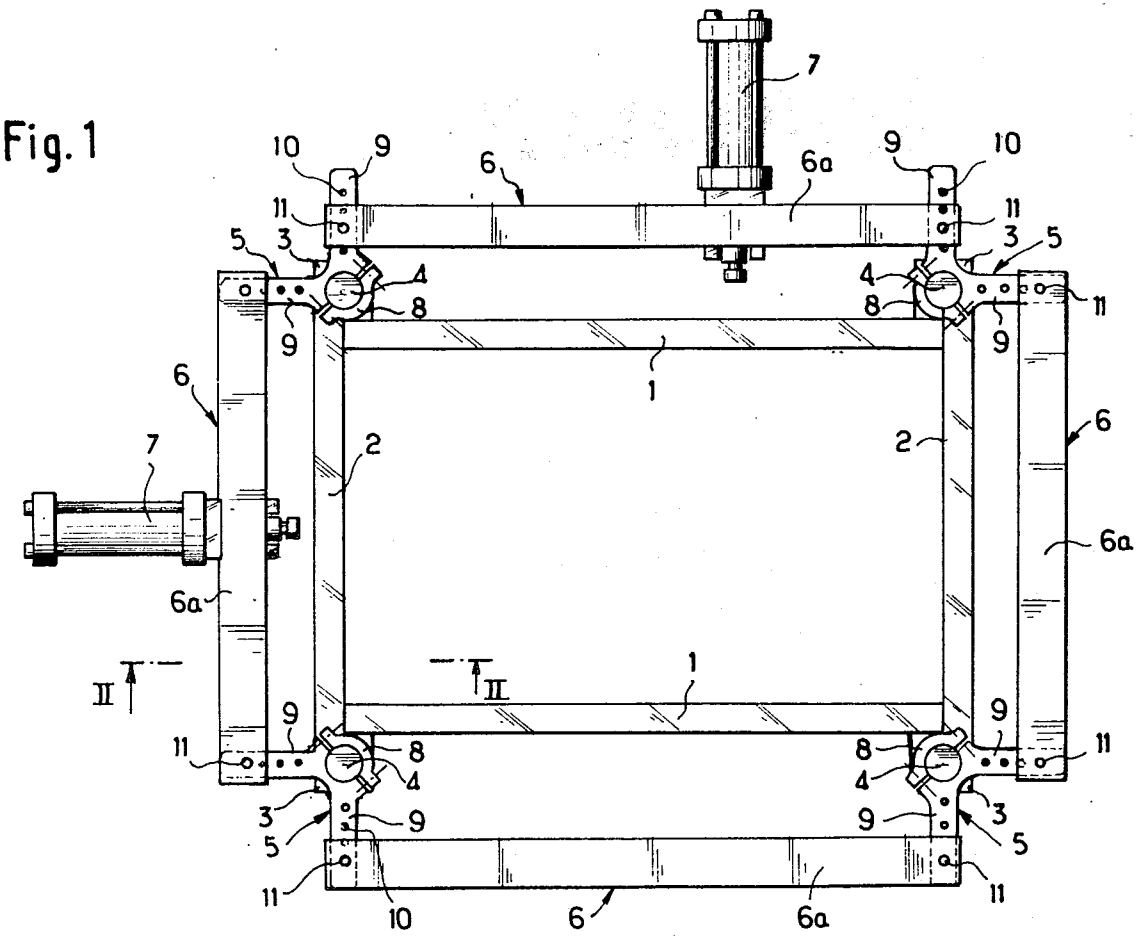
FIG. 1 is a schematic horizontal sectional view showing the lower part of the framework of a moulding machine in accordance with the invention.
Figure 2:
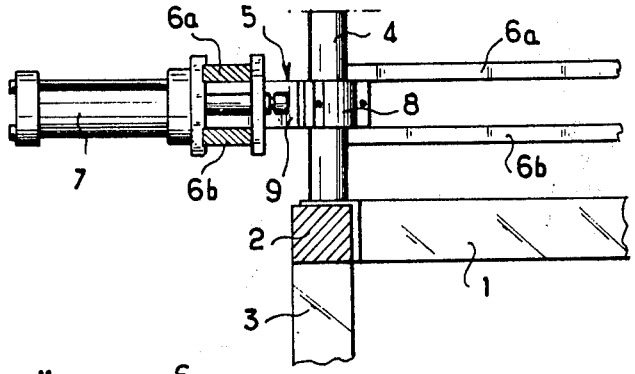
FIG. 2 is a sectional view along line II—II of FIG. 1.

The lower part of the framework of the moulding machine which can be seen in FIGS. 1 and 2 is essentially formed from a horizontal frame defined by two longitudinal side members 1 and two transverse side members 2, four vertical uprights 3 supporting the horizontal frame and four cylindrical bars 4 fixed vertically to the upper part of uprights 3.

The cylindrical bars 4 form guide devices for supports 5 on which are fixed bearing elements 6 for receiving the core extraction or middle part extraction jacks 7 of the moulding machine.

In the example shown in the drawings, the bearing elements 6 are each formed by two flat bars *6a, 6b* applied against the upper and lower faces of supports 5 (see in particular FIG. 2). They are four in number and are respectively parallel to side members 1 and 2. As for the two jacks 7, which can be seen in FIG. 1, they are mounted on two adjacent bearing elements and are intended to move, one a longitudinal core extractor and the other a transverse core extractor. It is evident that a jack 7 could be mounted on each bearing element 6.

In accordance with the invention, the supports shown in FIGS. 1 to 5 each comprise a collar 8 clamping the corresponding guide bar 4 and two arms 9 integral with collar 8, these arms forming a right angle therebetween.

Collar 8 of each support is formed from two complementary parts assembled one against the other by means of bolts or similar, shown symbolically by broken lines in the drawings. Because of the special construction of their collar, supports 5 may be readily mounted on guide bars 4, even if the ends of these latter support members preventing supports 5 from being fitted on or removed. It is sufficient in fact to place the component parts of each collar around the corresponding guide bar, at the desired height, and to join them together.

Arms 9 each comprise four equidistant bores 10, the number thereof being possibly different. Two bolts 11 cooperating with one of the bores 10 of arms 9 provides fixing of a bearing element 6 on these latter.

In the example shown in FIG. 1, the arms of the supports are situated outside the frame defined by side members 1 and 2, one of them being parallel to side members 1, whereas the other is parallel to side members 2. The transverse bearing elements 6 are fixed at the level of the fourth bore of the horizontal arms 9. As for the longitudinal bearing elements 6, they are fixed, one at the level of the fourth bore in the two lower vertical arms and the other at the level of the second bore in the two upper vertical arms.

It is however evident that each bearing element could be fixed to the corresponding arm 9 in four different positions, each of them being determined by a bore 10.

Figure 3:
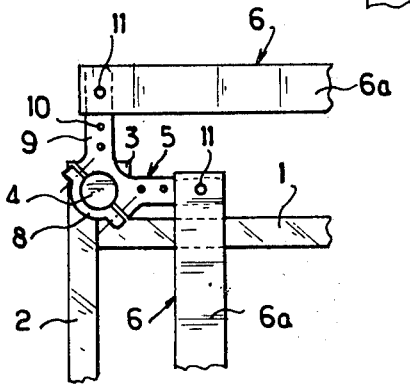
FIGS. 3 to 5 show the support clamping the guide bar situated at the top left of FIG. 1, this support being shown in three other angular positions.

FIG. 3 shows support 5 clamping the guide bar at the top left of FIG. 1, this support having been rotated by 90° in a clockwise direction from its initial position. In this case, the longitudinal bearing element 6 is again outside the frame. On the other hand, the transverse bearing element 6 is inside the frame.

Figure 4:
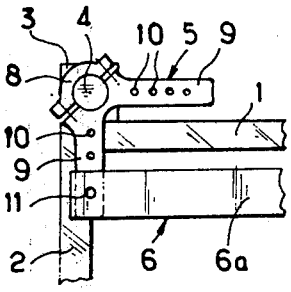

FIG. 4 shows the support represented in FIG. 3 after a further 90° rotation in a clockwise direction. In this case, a single bearing element 6 may be fixed to the support.

Figure 5:
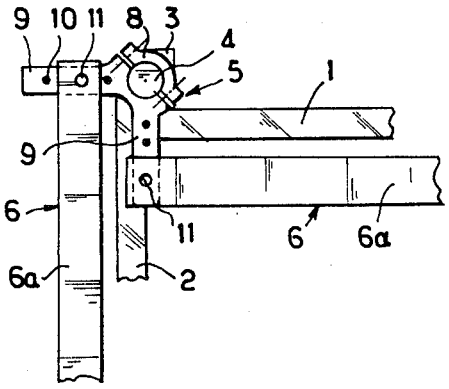

FIG. 5 shows the support of FIG. 4 after a further 90° rotation in a clockwise direction. For this position of support 5, the longitudinal bearing element 6 is inside the frame whereas the transverse bearing element is outside.

When moulds of different sizes are to be mounted on a moulding machine having a framework such as has just been described, it will be readily understood that by suitably positioning supports 5 on guide bars 4 and bearing element 6 on arms 9, it is possible to accurately adjust the distance separating jacks 7 from the mould used.

Naturally, the moulding machine could comprise one or more jacks 7 on each of the bearing elements 6. Similarly, several supports 5 on which would be fixed additional bearing elements for other jacks could be mounted on each guide bar 4.

On the other hand, in the case where the moulding machine has lower and/or upper core extractors, its framework could also comprise horizontal guide bars for mounting other supports 5 for fixing the elements bearing lower and/or upper core extraction jacks.

Figure 6:
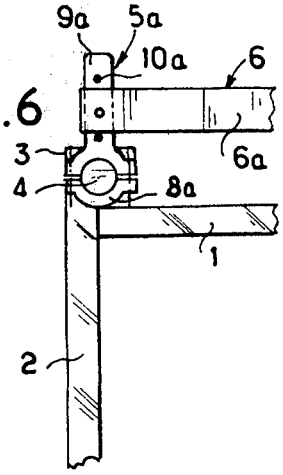
FIG. 6 shows a support comprising a single arm.

Referring now to FIG. 6, a support *5a* can be seen in accordance with a variation. Like the supports 5 which have just been described above, support *5a* comprises a collar *8a* clamping a guide bar 4 and formed in its turn by two complementary parts assembled one against the other by means of bolts or similar. On the other hand, it only comprises a single arm *9a*. It may then only support a single bearing element 6. Four bores *10a* are formed in arm *9a* but it is evident that the number of these bores could be different.

Figure 7:
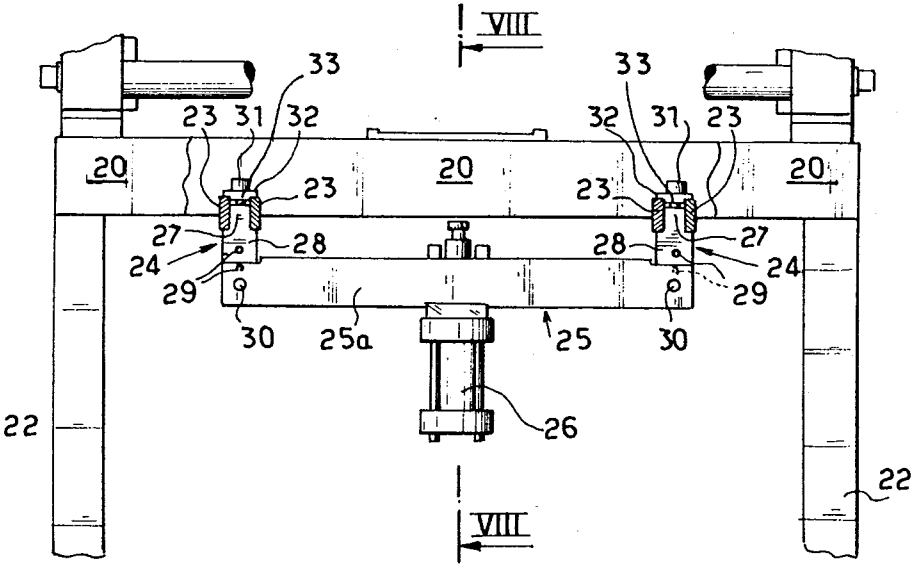
FIG. 7 is a partial front view, with parts cut away and partially in section, of the lower part of the framework of another moulding machine in accordance with the invention.
Figure 8:
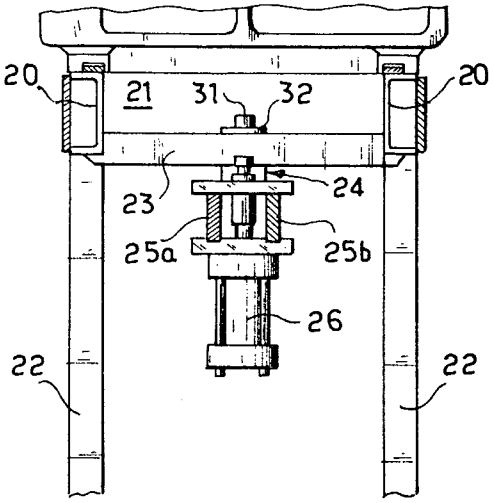
FIG. 8 is a sectional view along line VIII—VIII of FIG. 7.

From FIG. 6 it will be readily understood that support 5 may be secured against movement on guide bar 4 in four privileged positions staggered by 90° with respect to each other. The lower part of the framework of the moulding machine which can be seen in FIGS. 7 and 8 comprises in its turn a horizontal frame defined by two longitudinal side members and two transverse side members, respectively 20 and 21, and four vertical uprights 22 supporting the frame.

In the example shown, two pairs of flat bars 23 are fixed at the same height on the longitudinal side members 20, parallel to the transverse side members 21. These flat bars 23, which are disposed vertically, form guide devices for two supports 24 on which is fixed a bearing element 25 supporting the lower core extraction jack 26 of the moulding machine. The bearing element 25 for jack 26, like the above mentioned bearing element 6, is formed from two flat bars *25a, 25b* applied against two opposite faces of supports 24.

In accordance with the invention, supports 24 each comprise in this case a boss 27 inserted with a small clearance in the constant width gap provided between the flat bars 23 of the corresponding pair and extending therebelow through an arm 28 having equidistant bores 29 (three in the example shown).

One of the bores 29 of arms 28 receives the shank of a bolt 30 for fixing the bearing element 25 to supports 24. Supports 24 are secured against movement on their guide device by means of a screw 31 whose head bears on a washer 32 (provided on its lower face with two notches defining a central projecting part 33 inserted with a small clearance between the flat bars 23) and whose shank is screwed into the free end of their bosses 27.

It will be readily understood that by introducing bolts 30 into the different bores 29 of supports 24, the height of the jack 26 may be modified and so this latter may be correctly positioned with respect to the mould used on the machine. Similarly, by slightly slackening screws 31, supports 24 may be slid along flat bars 23 and jack 26 thus brought to the position which is best adapted to its use.

It will be noted here that the framework of the machine could also comprise two other pairs of flat bars 23 at its upper part. These flat bars could then serve as guide devices for other supports 24 on which would be fixed the bearing element for a core extraction jack placed at the top part. This same framework could also comprise on each of the sides thereof two pairs of flat bars 23 situated one above the other. In this case, these flat bars would be disposed horizontally and could serve as guide devices for supports 24 on which would be fixed the bearing elements for the longitudinal and/or lateral core extraction jacks of the moulding machine.

I claim:

1. A moulding machine, and especially a chill moulding machine, comprising a framework and at least one core or middle part extraction jack 7 mounted on a bearing element 6 movable on the framework characterized in that the bearing element 6 is carried by at least two supports 5 secured against movement on guide devices 4 provided on the framework and in that the supports 5 each comprise a securing member 8 locked on the corresponding guide device 4 and each support 5 comprises two arms 9 positioned at right angles to each other and integral at their proximal ends with the supports 5 and means 11 mounting the ends of the bearing element 6 to an arm 9 of each of the supports 5.

2. A moulding machine according to claim 1 wherein the guide devices 4 are posts positioned perpendicular to the framework upon which the supports are mounted and are adjustable about the vertical axis of said guide device to position the arms at different angular positions relative to the framework.

3. A moulding machine according to claim 1 wherein the arms 9 are provided with spaced holes for receiving the means 11 for mounting the bearing element to the arms.

4. A moulding machine, and more specifically a chill moulding machine, comprising a framework and at least one core or middle part extraction jack 26 mounted on a bearing element 25 movable on the framework characterized in that the bearing element 25 is carried by at least two supports 24 secured against movement on guide devices 23 provided on the framework, each guide device 23 comprising two flat bars 23 between which there is provided a constant width gap and the supports 24 each comprise securing members 27 locked on the guide devices 23 in the form of bosses 27 inserted between the flat bars 23 and each support 24 comprising at least one arm 28 integral with the boss member 27 and means 30 for fixing the ends of the bearing element 25 to the arms 28 of the supports 24.

5. A moulding machine according to claim 4 wherein the guide devices 23 are bars fixed to the framework in a horizontal position and supports 24 are movable along said bars to position the bearing element 25 at different positions transversely of the framework.

6. A moulding machine according to claim 4 wherein the arms 28 are provided with spaced holes for receiving the means 30 for mounting the bearing element to the arms.

7. A moulding machine comprising a horizontal, substantially rectangular, rigid frame defined by spaced, parallel, longitudinal and transverse side members joined at their intersecting ends, guide devices provided on the framework, at least two supports, securing means locking the two supports to the corresponding guide devices, an arm integral at one end with each support, each arm having a distal end defining a support situated in a plane spaced from and parallel to the side members of the framework, means connecting the opposite ends of a bearing element to the distal end of the arms such as to support said bearing member in spaced, parallel relation to the side members of the framework and an extraction jack mounted on the bearing element and movable therewith relative to the framework.

8. A moulding machine according to claim 7 wherein the supports are movable on the guide devices to, in turn, move the bearing elements and jack supported thereby relative to the frame member.

9. A moulding machine according to claim 8 wherein the guide devices are cylindrical bars fixed to the framework and the supports are rotatable about the axes of the cylindrical bars to, in turn, position the bearing element at different positions transversely of the framework.

* * * * *